US006019295A

United States Patent [19]

McKenzie

[11] Patent Number: 6,019,295

[45] Date of Patent: Feb. 1, 2000

[54] ADJUSTABLE ARC FIXED SPRAY SPRINKLER NOZZLE

[75] Inventor: Jeff R. McKenzie, Riverside, Calif.

[73] Assignee: The Toro Company, Minneapolis, Minn.

[21] Appl. No.: 08/861,412

[22] Filed: May 21, 1997

[51] Int. Cl.[7] ..... B05B 1/32

[52] U.S. Cl. ..... 239/451; 239/551; 239/554; 239/DIG. 1

[58] Field of Search ..... 239/390, 392, 239/394, 436, 437, 442, 443, 444, 451, 460, 537, 538, 551, 555, 596, DIG. 1, 581.1, 579

[56] References Cited

U.S. PATENT DOCUMENTS

| | | | |
|---|---|---|---|
| 682,590 | 9/1901 | Greer . | |
| 1,383,404 | 7/1921 | Kirgan | 239/554 |
| 2,075,589 | 3/1937 | Munz | 239/460 |
| 3,613,995 | 10/1971 | Kane | 239/538 |
| 3,642,206 | 2/1972 | Waldrum . | |
| 4,579,285 | 4/1986 | Hunter . | |
| 4,739,934 | 4/1988 | Gewelber | 239/446 |
| 4,850,538 | 7/1989 | Krahn . | |
| 4,898,332 | 2/1990 | Hunter et al. | 239/581.1 |
| 5,058,806 | 10/1991 | Rupar | 239/451 |
| 5,083,709 | 1/1992 | Iwanoski . | |
| 5,148,990 | 9/1992 | Kah, Jr. . | |
| 5,322,223 | 6/1994 | Hadar . | |
| 5,360,167 | 11/1994 | Grundy et al. | 239/460 |
| 5,556,036 | 9/1996 | Chase | 239/457 |
| 5,588,594 | 12/1996 | Kah, Jr. | 239/451 |
| 5,630,549 | 5/1997 | Le | 239/451 |

FOREIGN PATENT DOCUMENTS

| | | |
|---|---|---|
| 173486 | 11/1905 | Germany . |

*Primary Examiner*—Andres Kashnikow
*Assistant Examiner*—Lisa Ann Douglas
*Attorney, Agent, or Firm*—James W. Miller

[57] ABSTRACT

A fixed spray sprinkler nozzle has adjustable arc coverage. The nozzle has a nozzle body with sideward facing water discharge slots including a bottom slot and a top slot. Flow blocking skirts control the open length of each of the slots. The bottom slot is fixed on the nozzle body, but the top slot is rotatable on the nozzle body, in concert with the opening or unblocking of the bottom slot's length, from a position overlying the bottom slot to a position directed in an opposite direction from the bottom slot. When the bottom slot is fully open, the top slot may then be progressively opened over its entire length. Thus, the arc coverage can be infinitely adjusted over the combined circumferential length of both the bottom and top slots together. The slots have a grooved bottom wall to provide smooth water flow and good pattern definition at each side of the selected arc.

18 Claims, 7 Drawing Sheets

ADJUSTABLE ARC FIXED SPRAY SPRINKLER NOZZLE

TECHNICAL FIELD

This invention relates to a fixed spray sprinkler nozzle having an adjustment for adjusting the arc of ground watered by the nozzle from approximately 0° to approximately 360°.

BACKGROUND OF THE INVENTION

A fixed spray sprinkler nozzle does not rotate during operation. Consequently, the arc of ground watered by such a nozzle is primarily determined by the configuration of the water discharge orifices in the nozzle. Such nozzles are typically made with different numbers and/or shapes of discharge orifices so that different nozzles will water different preset arcs. Thus, for a particular sprinkler to water a 90° arc, a nozzle which has been built to water a 90° arc will be installed on that sprinkler.

The practice of using different nozzles to water different arcs has various disadvantages. For example, the installer has to stock all of the different nozzles for the different arcs, which is obviously costly and inconvenient. Moreover, to adjust an existing sprinkler from one arc to another, the installer has to first remove the old nozzle and then install a new nozzle configured to water the desired arc. In addition to the labor involved in this process, the old nozzle is often just thrown away, thereby making this method of arc adjustment somewhat wasteful.

The art has recognized these deficiencies and has attempted to provide a "universal" fixed spray sprinkler nozzle, i.e. a single nozzle having an adjustable arc coverage. In nozzles in which the water discharge orifice comprises an elongated slot extending around the circumference of the nozzle, a rotatable flow controlling skirt abuts against the inside of the slot to control the open length of the slot. When the skirt fully covers the slot, no flow is allowed through the nozzle and the sprinkler is shut off. As the skirt is rotated to begin uncovering the slot, the arc coverage is progressively increased until the slot is fully open with the sprinkler watering its maximum arc. U.S. Pat. No. 682,590 to Greer shows an adjustable nozzle of this type.

Nozzles having a water discharge slot located at a constant axial height along the axis of the nozzle, as in Greer, are typically adjustable only between 0 and 180°. Obviously, even if a slot is cut all the way around the circumference of the nozzle, the flow blocking skirt always blocks some portion of the slot. Thus, the slot typically extends only about halfway around the nozzle. Since the maximum arc coverage of this type of nozzle is limited to 180° or so, it does not fulfill the need for a "universal" nozzle whose arc could be adjusted all the way up to 360° if so desired.

SUMMARY OF THE INVENTION

One aspect of this invention relates to an adjustable arc fixed spray sprinkler nozzle which comprises a nozzle body having a top and sides with the nozzle body having an axis. A plurality of water discharge slots are provided in the sides of the nozzle body with the slots pointing outwardly relative to the axis of the nozzle body such that water is discharged to the sides of the nozzle body through the slots. A plurality of rotatable skirts carried on the nozzle body extend parallel to the axis of the nozzle body with one skirt being in abutment with each water discharge slot, each skirt being progressively rotatable from a first position in which the skirt imposes minimum interference with the water discharge slot to a second position in which the skirt imposes maximum interference with the water discharge slot. The arc coverage provided by the water flow through the water discharge slots is controlled by the position of the flow blocking skirt for each slot.

Another aspect of this invention relates to an adjustable arc fixed spray sprinkler nozzle which comprises a nozzle body having at least two, sideward facing water discharge slots provided in the nozzle body. At least one water discharge slot is fixed relative to the nozzle body and at least one water discharge slot is rotatable relative to the nozzle body from a first position in which the rotatable water discharge slot at least partially overlies the fixed water discharge slot to a second position in which the rotatable water discharge slot has been rotated out of its overlying position and is oriented in a different direction from the fixed water discharge slot.

A further aspect of this invention relates to an adjustable arc fixed spray sprinkler nozzle which comprises a nozzle body having a top and sides. At least two water discharge slots are provided in the sides of the nozzle body. At least two flow blocking members are movably carried on the nozzle body, wherein one flow blocking member is associated with each of the slots for adjustably blocking the slot's length to thereby control the arc coverage provided by the slot. A single, user operable adjustment member is movably carried on the nozzle body for moving both flow blocking members relative to their associated slots.

An additional aspect of this invention relates to an adjustable arc fixed spray sprinkler nozzle which comprises a nozzle body having a top and sides. At least one water discharge slot is provided somewhere in the sides of the nozzle body which slot is adjustable in length to thereby control the arc coverage provided by the slot. A rotatable adjustment ring forms an exterior portion of the top of the nozzle body with the adjustment ring rotating around a fixed interior portion of the top of the nozzle body. The adjustment ring is sized to be gripped and turned by hand, the adjustment ring when so turned adjusting the length of the water discharge slot to change the arc coverage.

Yet another aspect of this invention relates to an adjustable arc fixed spray sprinkler nozzle which comprises a nozzle body having at least one sideward facing water discharge slot provided in the nozzle body which slot is adjustable in length to thereby control the arc coverage provided by the slot. The slot includes a bottom wall provided with radially extending grooves to help water flow smoothly out through the slot.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 2:
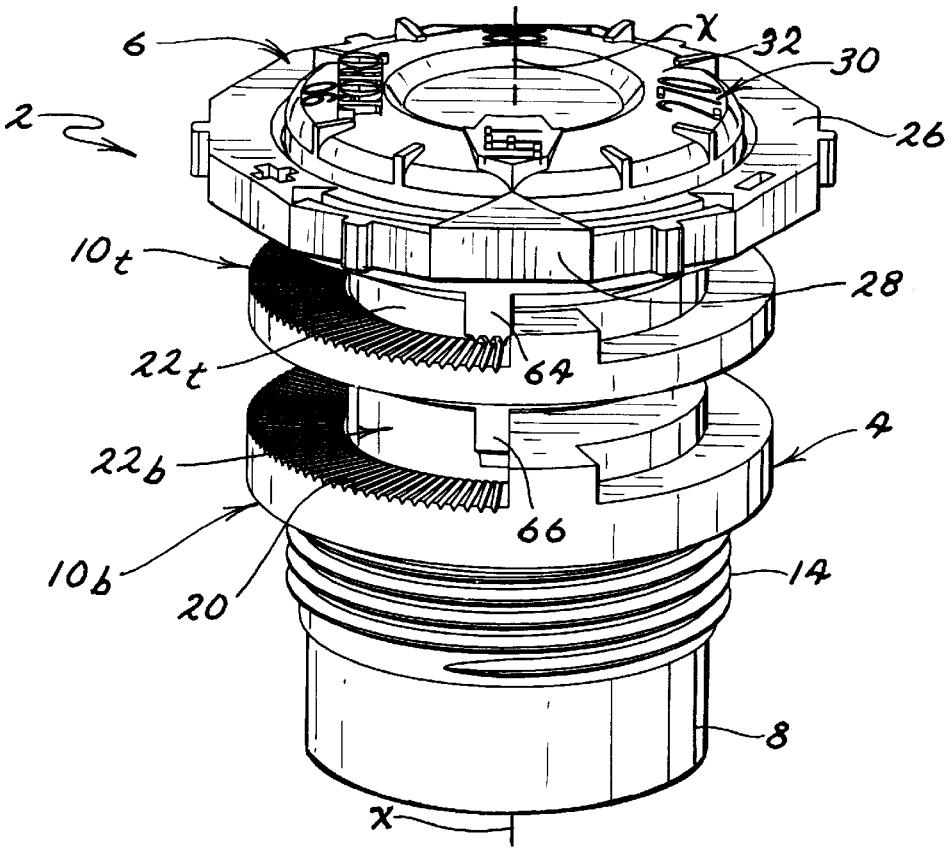
FIG. 2 is a perspective view of the nozzle of FIG. 1, shown assembled and fully closed.

Referring first to FIG. 2, this invention relates to a fixed spray sprinkler nozzle 2 comprising a generally cylindrical nozzle body 4 having a central axis x. Nozzle body 4 has a closed end 6 and an open end 8 through which water enters nozzle body 4. At least two water discharge slots 10 extend at least partially around the sides of nozzle body 4. Thus, water entering nozzle body 4 through open end 8 thereof is confined within nozzle body 4 until exiting through slots 10 in a spray directed to the sides of nozzle body 4. The width or angular extent of this spray determines the arc coverage provided by nozzle 2, which arc coverage is adjustable in nozzle 2 as described hereafter.

Nozzle body 4 is normally oriented vertically when used as a fixed spray sprinkler nozzle. Closed end 6 of nozzle body 4 forms the top of nozzle 2 while open end 8 of nozzle body 4 forms the bottom of nozzle 2. open end 8 of nozzle body 4 can include threads 14 for allowing nozzle 2 to be attached to a water delivering conduit, i.e. to either a fixed standpipe or atop the riser portion of a pop-up sprinkler. Nozzle body 4 will be shown in this vertical orientation in the drawings of this patent application and the components of nozzle 2 will be described with reference to this vertical orientation. However, nozzle body 4 is not limited for use in a vertical orientation, but could be set in other non-vertical orientations if so desired.

Figure 1:
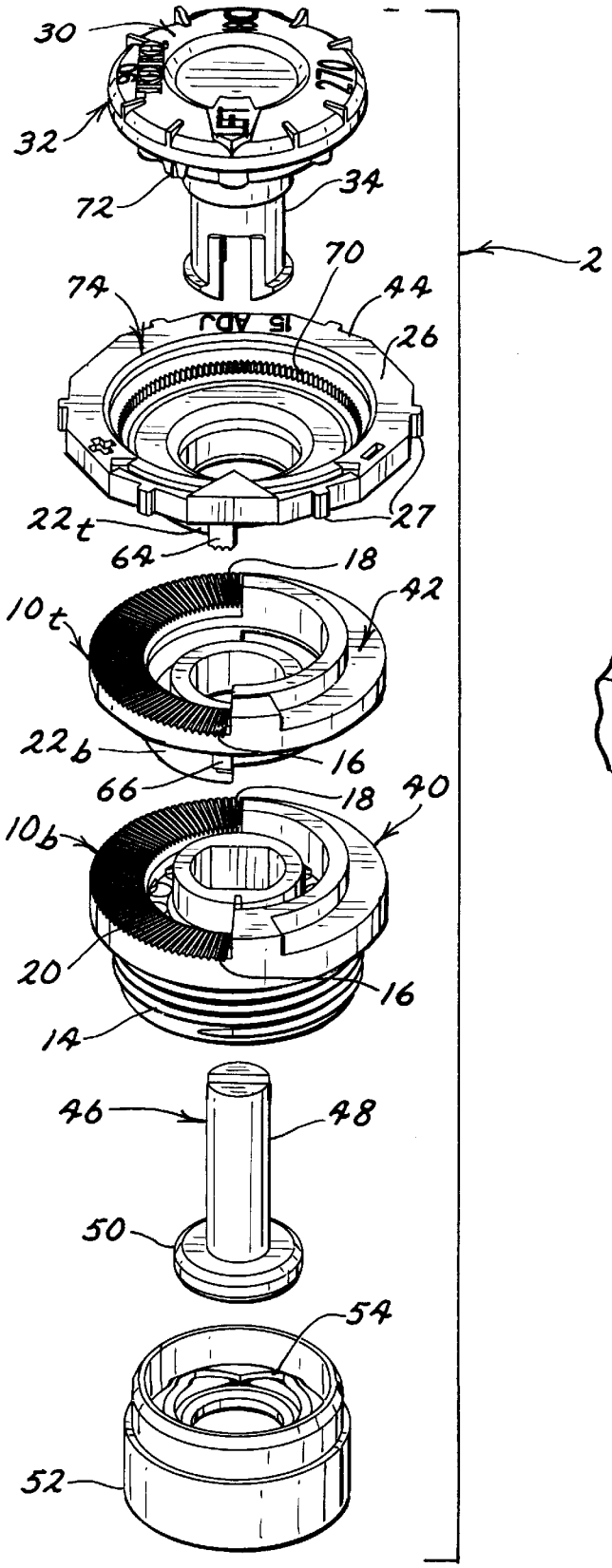
FIG. 1 is a perspective view of the adjustable arc, fixed spray sprinkler nozzle of this invention, shown in an exploded form for the sake of clarity.

Referring to FIG. 1, each slot 10 extends around approximately 180° of the circumference of nozzle body 4 between a left end 16 and a right end 18. Each slot 10 includes a bottom wall that is radially grooved as shown at 20, the grooved portion 20 having the same arcuate extent as the circumferential length of the slot. Grooves 20 help water flow smoothly out of slots 10 in a radially outward direction. Each slot 10 thus is able to project a fan shaped spray of water out to the side of nozzle 2, the arcuate extent of the fan shaped spray of water depending upon how much of slot 10 is open.

Each slot 10 has a fixed axial position along the axis of nozzle body 4 such that each slot has a constant height above the ground when nozzle 2 is vertically oriented. However, slots 10 are offset along the axis of nozzle body 4. Thus, one slot 10 is located vertically above the other slot 10. Accordingly, the top slot 10 will be designated and referred to herein as $\mathbf{10}_t$ (with the subscript t standing for top) while the bottom slot 10 will be designated and referred to herein as $\mathbf{10}_b$ (with the subscript b standing for bottom). The subscript designation will be used in conjunction with the numeral 10 whenever it is required to distinguish between the two slots. If no subscript designation is used in conjunction with the numeral 10, that description applies to both slots equally.

Separate, flow controlling members or skirts 22 are rotatably carried on nozzle body 4 for abutting engagement with the inside diameter of each slot 10. Because slots 10 are vertically offset into a top slot $\mathbf{10}_t$ and a bottom slot $\mathbf{10}_b$, skirts 22 are similarly vertically offset into a top skirt $\mathbf{22}_t$ and a bottom skirt $\mathbf{22}_b$.

Each skirt 22 is rotatable about the axis of nozzle body 4 to progressively block the open length of the corresponding slot 10. Each skirt 22 has a closed, minimum flow position in which slot 10 has been completely blocked to allow no water to pass through slot 10. Each skirt 22 has an open, maximum flow position in which the entire length of slot 10 is completely open to allow water to pass out through the entire length of slot 10. Each skirt 22 is infinitely adjustable between these two positions to progressively increase the effective open length of each slot 10.

One slot 10 is positioned on nozzle body 4 to point to one side of nozzle body 4, i.e. to cover the arc beginning at 0° and extending to 180°. The other slot 10 can be arranged on nozzle body 4 to point to the other side of nozzle body 4, i.e. to cover the arc from 180° to 360°. Thus, if both slots 10 are completely open, i.e. the respective flow controlling skirts 22 have been rotated out of the way of both slots 10, water will exit in a substantially complete circle from nozzle body 4 to water an approximately 360° arc. Slots 10 can be progressively blocked by skirts 22 to adjust the arc coverage to any lesser desired amount all the way down to 0°, i.e. all flow through nozzle 2 is stopped because both skirts 22 completely block the entire length of both slots 10.

A single, user operable, rotatable member is provided for rotating both of skirts 22 in a progressive manner to open and/or close slots 10. This member is desirably an adjustment ring 26 that forms the exterior portion of the top of nozzle 2 to allow the user to adjust nozzle 2 from above nozzle 2. The outer diameter of ring 26 can be shaped as a polygon and include outwardly extending tabs or ribs 27 to allow the user to easily grip the outer diameter of ring 26 and turn ring 26 by hand. Ring 26 preferably includes an arrow 28 that moves with ring 26 as the arc adjustment is being made. This arrow 28 can be read against a scale 30 formed on a scale member 32 that forms a fixed, interior portion of the top of nozzle 2 to allow the arc that has been set on nozzle 2 to be read from above nozzle 2. Thus, if arrow 28 points to the numeral 180 in scale 30, this means that nozzle 2 has been adjusted to water a 180° arc.

In a preferred embodiment of a nozzle 2 according to this invention, nozzle body 4 is made from three primary parts, a bottom section 40, a middle section 42 and a top section 44. Bottom slot $\mathbf{10}_b$ is formed as part of bottom section 40 and top slot $\mathbf{10}_t$ is formed as part of middle section 42. Bottom skirt $\mathbf{22}_b$ for blocking flow through bottom slot $\mathbf{10}_b$ is part of middle section 42 and points downwardly from middle section 42 to lie in back of bottom slot $\mathbf{10}_b$. Similarly, top skirt $\mathbf{22}_t$ for blocking flow through top slot $\mathbf{10}_t$ is part of top section 44 and points downwardly from top section 44 to lie in back of top slot $\mathbf{10}_t$. Adjustment ring 26 is integral with top section 44 such that gripping and rotating adjustment ring 26 serves to rotate top section 44 about the vertical axis of nozzle 2.

The bottom, middle and top sections 40, 42 and 44 are stacked on top of one another with water flow passageways 41 being provided in bottom and middle sections 40 and 42 to allow water passing through open end 8 of nozzle 2 to reach slots 10b and 10t. The bottom, middle and top sections 40, 42 and 44 are held together by a downwardly pointing hub 34 on scale member 32 that has a barbed lower end that snaps beneath a portion of bottom section 40. The shank 48 of screw 46 extends vertically upwardly through the various sections to be received in hub 34. Bottom section 40 is non-rotatable about shank 48 of screw 46. However, both the middle and top sections 42 and 44 are selectively rotatable about shank 48. Indeed, it is the rotation of these sections 42 and 44 which move the various flow blocking skirts 22 to accomplish an arc adjustment operation.

The head 50 of screw 46 is located at the bottom of nozzle body 4 in open end 8 of nozzle body 4. A cylindrical shell 52 having an upwardly facing valve seat 54 can be telescopically inserted into open end 8 of nozzle body 4 such that head 50 of screw 46 forms a valve member cooperable with valve seat 54. A user can insert a screwdriver into a slot contained in the top of screw 46 to cause head 50 of screw 46 to move towards or away from valve seat 54, thereby adjusting the volume of flow passing through nozzle 2 per unit of time. However, this invention does not relate to shell 52 and its cooperation with head 50 of screw 46, and could be used in a nozzle 2 having no shell 52 and thus a fixed flow volume.

Adjustment ring 26 is fixed to top section 44 to directly rotate that section and the top flow blocking skirt $\mathbf{22}_t$. Bottom flow blocking skirt $\mathbf{22}_b$ is not directly fixed to adjustment ring 26, but is in an abutting, frictional engagement therewith due to the stacking of top section 44 on top of middle section 42. To ensure that movement of adjustment ring 26 first moves bottom skirt $\mathbf{22}_b$ rather than top skirt $\mathbf{22}_t$, i.e. to first progressively open bottom slot $\mathbf{10}_b$ completely before top slot $\mathbf{10}_t$ starts to open, a detent 60 is provided that provides more friction acting between the top and middle sections 44 and 42 than between the middle and bottom sections 42 and 40. Thus, the initial 180° rotation of adjustment ring 26 first moves bottom flow blocking skirt $\mathbf{22}_b$ to its completely open position. Then, continued rotation of adjustment ring 26 through its final 180° of rotation will overcome the action of detent 60 and allow top skirt $\mathbf{22}_t$ to move out of the way of top slot $\mathbf{10}_t$.

Figure 14:
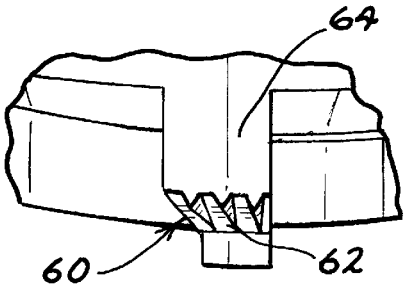
FIG. 14 is a perspective view of a portion of the nozzle of FIG. 1 illustrating a portion of a detent between the center and top nozzle sections.

While detent 60 could be formed in various ways, one convenient way of forming it to is to place a plurality of downwardly facing ridges or serrations 62 on the underside of an outwardly protruding stop 64 contained on top section 44. See FIG. 14. These ridges or serrations 62 mate with the grooved bottom wall 20 of top slot $\mathbf{10}_t$, to effectively link the top and middle sections 44 and 42 together. Thus, when the user initially applies torque to adjustment ring 26, this torque first rotates middle section 42 relative to bottom section 40 to begin uncovering bottom slot $\mathbf{10}_b$. When bottom slot $\mathbf{10}_b$ is fully open with the outwardly protruding stop 66 on bottom skirt $\mathbf{22}_b$ having moved from one end 16 of slot 10 to the other end 18, then continued torque applied to top section 44 will cause the ridges or serrations 62 on top section 44 to ratchet past the grooves 22 in the bottom wall of top slot $\mathbf{10}_t$, thus permitting top flow blocking skirt $\mathbf{22}_t$ to begin uncovering top slot $\mathbf{10}_t$.

Figure 3:
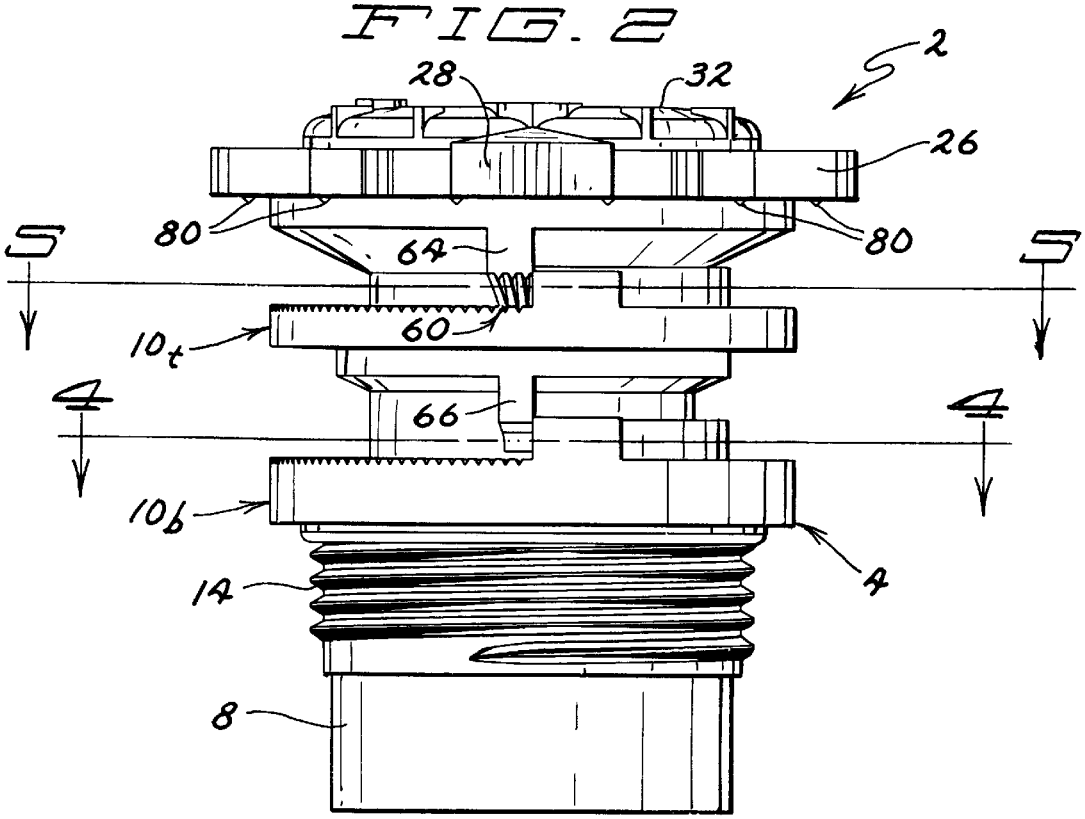
FIG. 3 is a side elevational view of the nozzle of FIG. 2.
Figure 5:
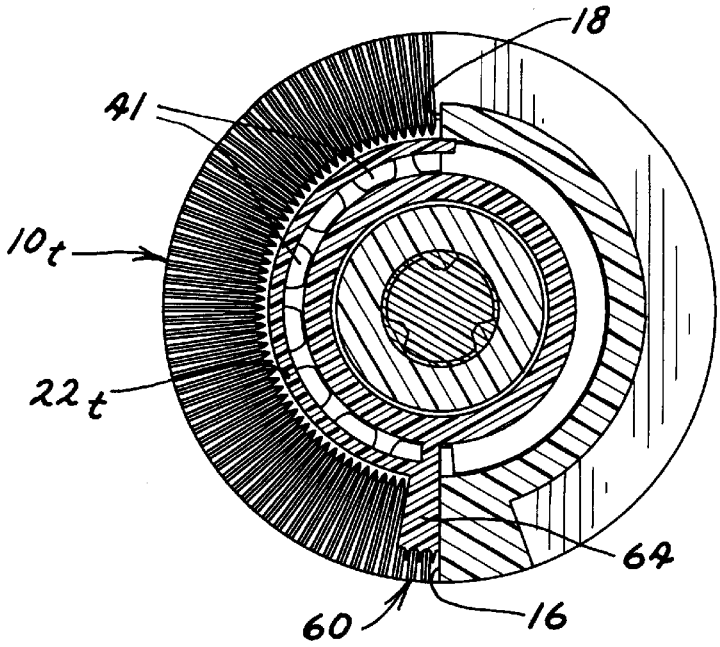
FIG. 5 is a cross-sectional view of the nozzle of FIG. 3, taken along lines 5—5 in FIG. 3.
Figure 4:
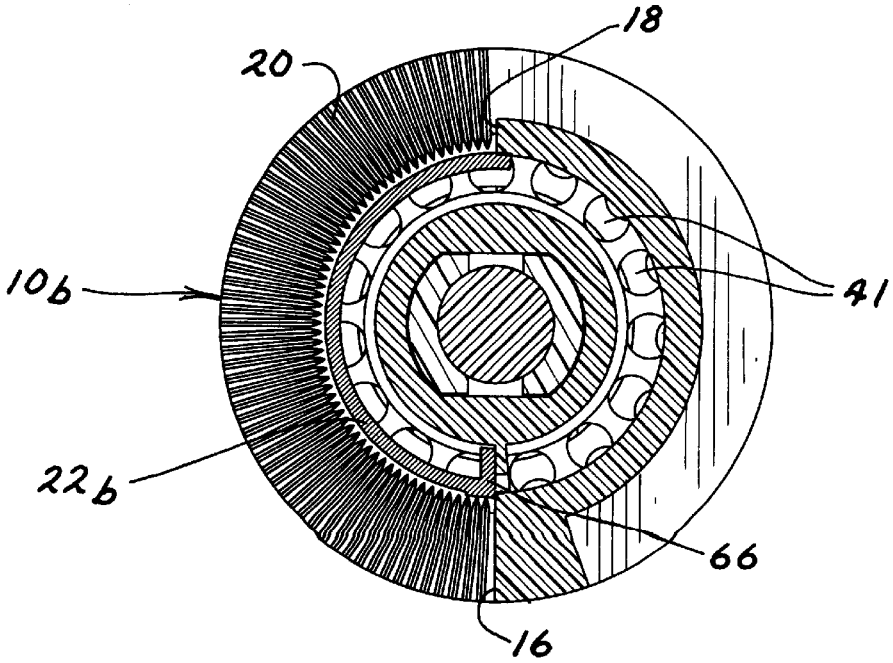
FIG. 4 is a cross-sectional view of the nozzle of FIG. 3, taken along lines 4—4 in FIG. 3.

The operation of nozzle 2 of this invention will now be more fully described. FIGS. 2 and 3 illustrate nozzle 2 in a fully closed position having a minimum arc coverage, i.e. preferably a 0° arc. In this position, both of the flow blocking skirts 22 overlie and block the length of both slots 10. See FIGS. 4 and 5 which illustrate this condition. Further, top slot $\mathbf{10}_t$ physically overlies bottom slot $\mathbf{10}_b$ such that both slots $\mathbf{10}_t$ and $\mathbf{10}_b$ point in the same direction. See FIG. 2. Arrow 28 on adjustment ring 26 points toward the word "Left" in scale 30 indicating that the movable side of the arc is aligned with the fixed Left side of the arc, i.e. that the arc coverage is set to 0°.

Figure 6:
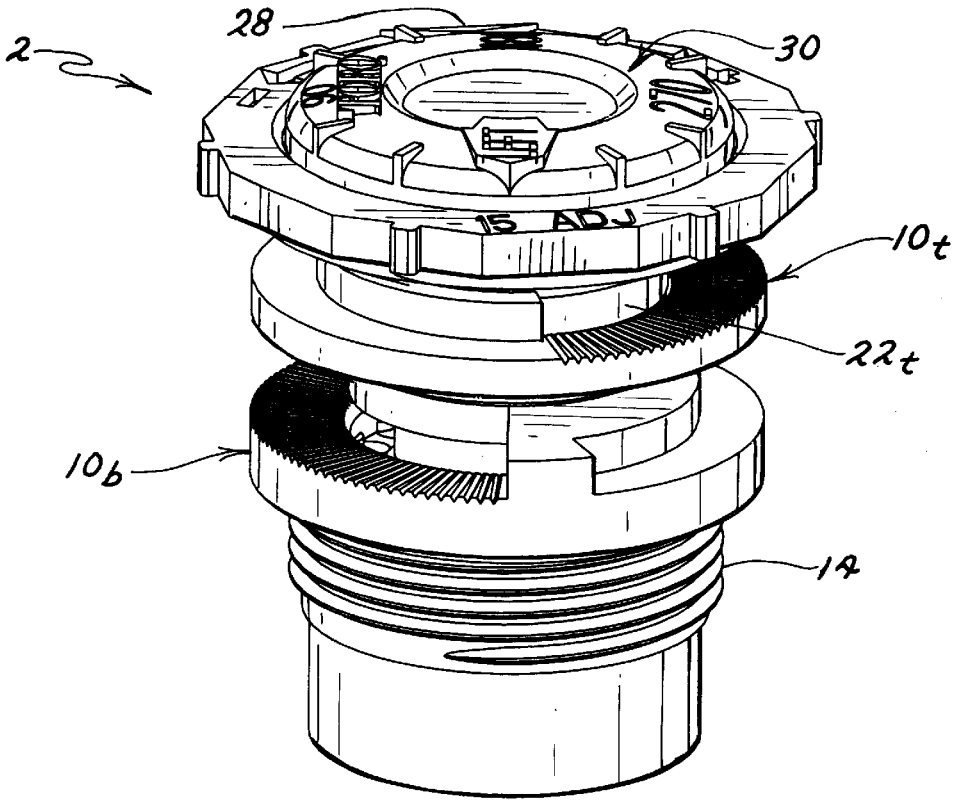
FIG. 6 is a perspective view of the nozzle of FIG. 1, shown assembled and open halfway to water an arc of approximately 180°.
Figure 7:
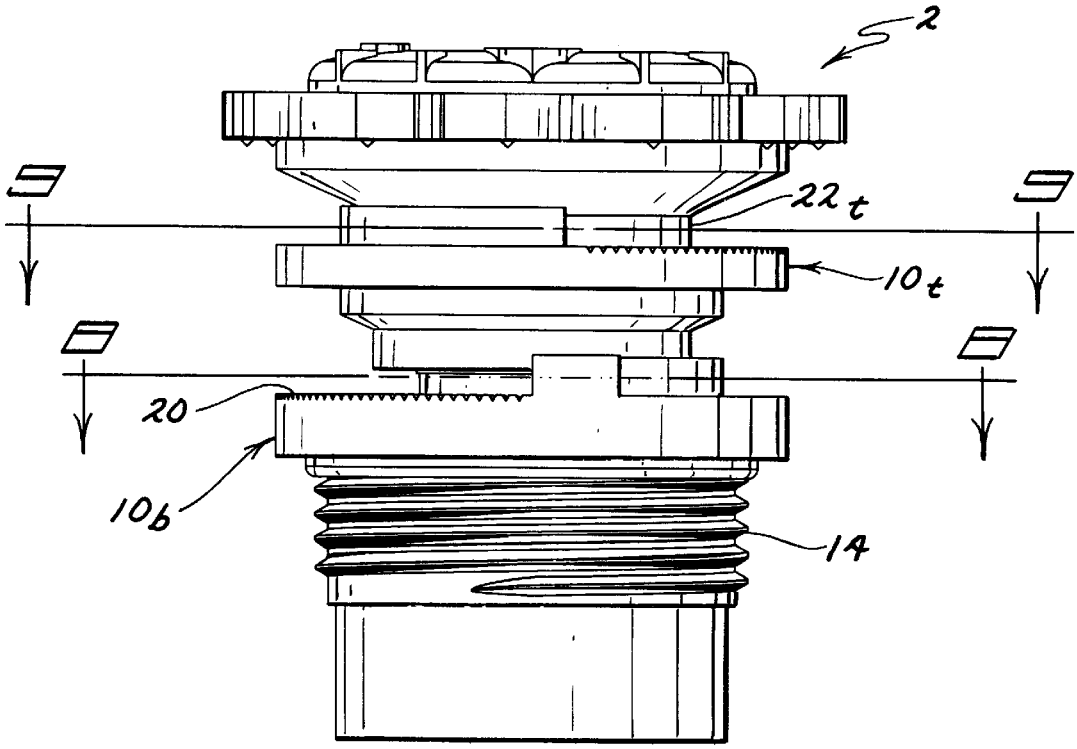
FIG. 7 is a side elevational view of the nozzle of FIG. 6.
Figure 8:
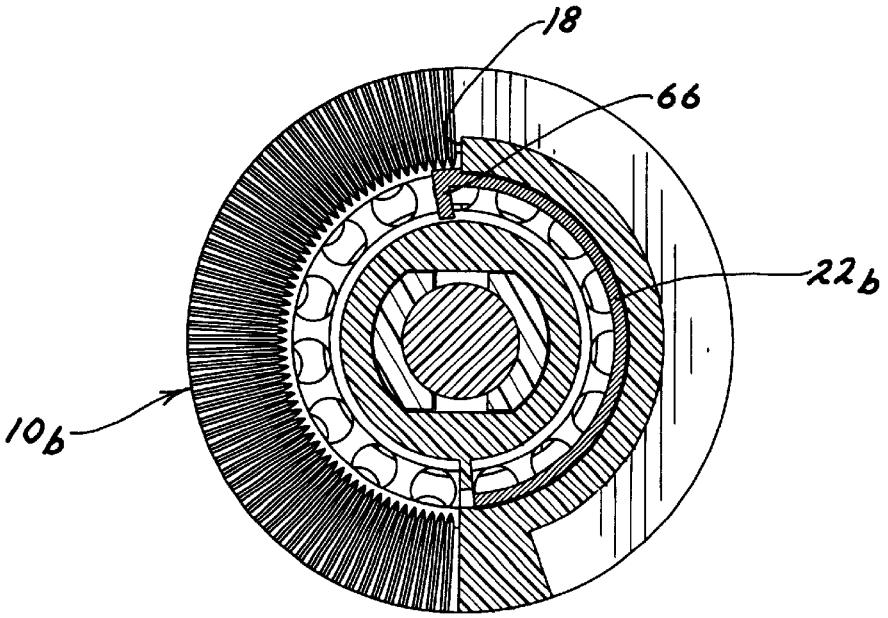
FIG. 8 is a cross-sectional view of the nozzle of FIG. 7, taken along lines 8—8 in FIG. 7.

If the user wishes to adjust nozzle 2 to any desired arc, he or she need only grip and rotate adjustment ring 26 in a clockwise direction to begin moving arrow 28 away from the "Left" mark on scale 30. As noted previously, this initially has the effect of rotating the top and middle sections 44 and 42 together due to the friction provided by detent 60 with both sections collectively rotating on top of the fixed bottom section 40. Such rotation causes bottom flow blocking skirt $\mathbf{22}_b$ to begin uncovering bottom slot $\mathbf{10}_b$ beginning from the fixed left end 16. The uncovering is incremental and infinite until stop 66 on bottom skirt $\mathbf{22}_b$ engages against the right end 18 of bottom slot $\mathbf{10}_b$. At this point, bottom slot $\mathbf{10}_b$ is fully open. See FIGS. 6–8 which show nozzle 2 adjusted until bottom slot $\mathbf{10}_b$ is fully open.

Figure 9:
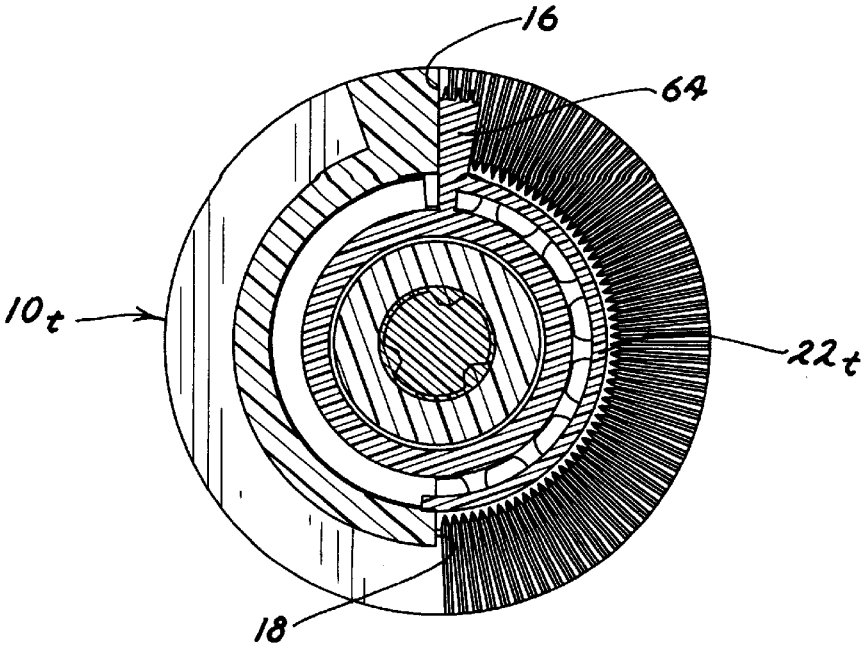
FIG. 9 is a cross-sectional view of the nozzle of FIG. 7, taken along lines 9—9 in FIG. 7.

At the point bottom slot $\mathbf{10}_b$ is fully open, the arc coverage is approximately 180° due to the circumferential length of bottom slot $\mathbf{10}_b$. Thus, water will spray in a semi-circular spray to one side of nozzle 2 through the open bottom slot $\mathbf{10}_b$. Top slot $\mathbf{10}_t$ is still fully closed, but it has physically been moved from its initial position in which it overlay bottom slot $\mathbf{10}_b$ to a new position in which it now points to the opposite side of nozzle 2. Compare FIG. 9 to FIG. 5 to see how top slot $\mathbf{10}_t$ swings around the axis of the sprinkler as bottom slot $\mathbf{10}_b$ is uncovered.

Figure 10:
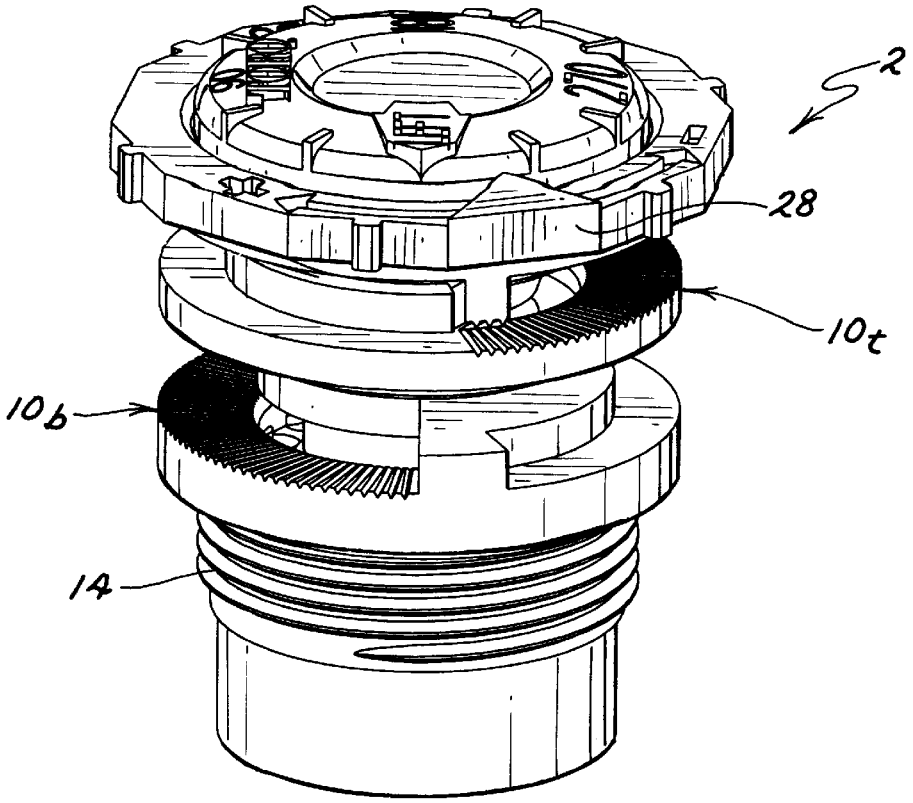
FIG. 10 is a perspective view of the nozzle of FIG. 1, shown assembled and fully open to water an arc of approximately 360°.
Figure 11:
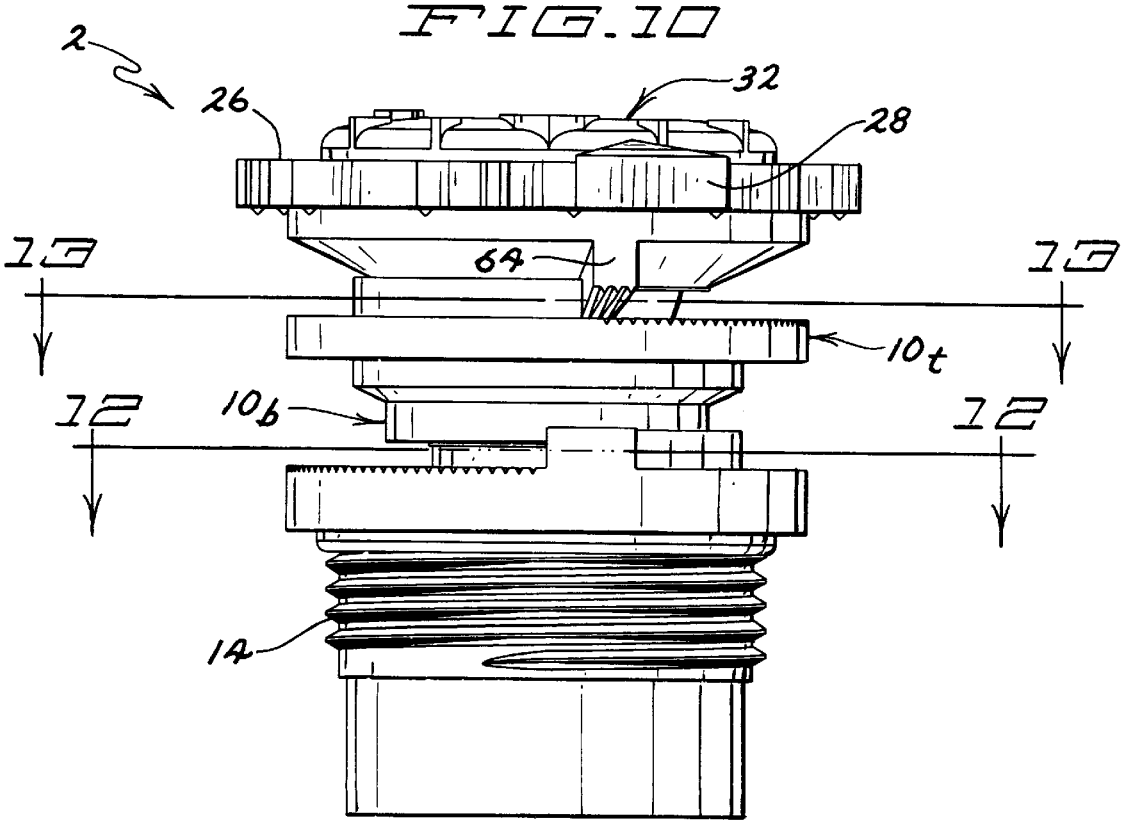
FIG. 11 is a side elevational view of the nozzle of FIG. 10.

To adjust nozzle 2 from its 180° arc coverage to its maximum arc, i.e. to approximately 360°, the user simply needs to keep rotating adjustment ring 26 in a clockwise direction when viewed from above. Because movement of middle section 42 is now precluded by engagement of stop 66 with the right side 18 of bottom slot $\mathbf{10}_b$, this additional rotation can only ratchet top section 44 over middle section 42 to begin moving top skirt $\mathbf{22}_t$ out of the way of top slot $\mathbf{10}_t$. Again, the uncovering movement of top slot $\mathbf{10}_t$ is incremental and infinite. This rotation can be continued until top skirt $\mathbf{22}_t$ has been fully moved out of the way of top slot $\mathbf{10}_t$. Thus, water now sprays in approximately 360° around nozzle 2 through both the bottom and top slots $\mathbf{10}_b$ and $\mathbf{10}_t$. See FIGS. 10 and 11 illustrating the fully open condition of nozzle 2.

Figure 13:
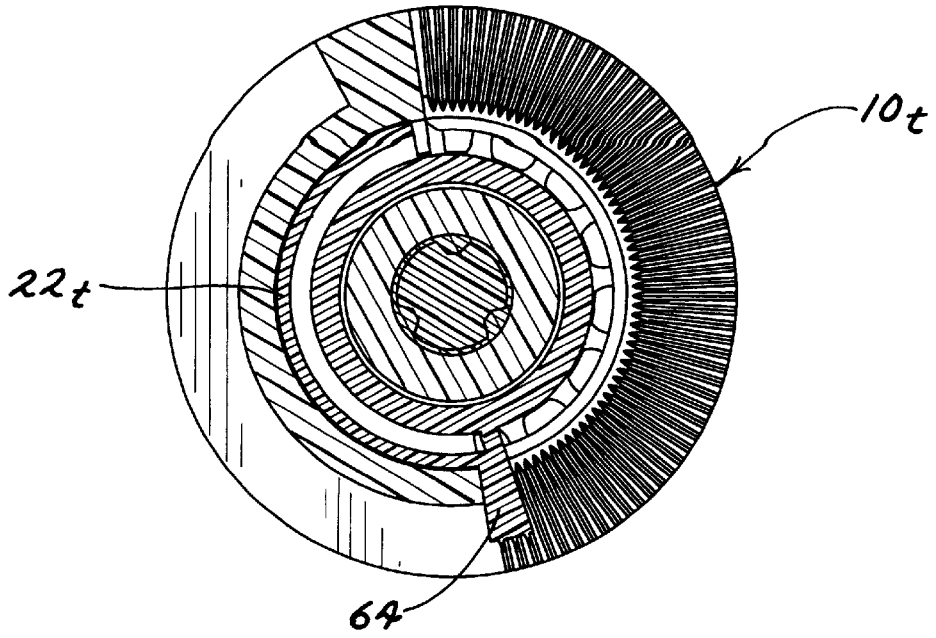
FIG. 13 is a cross-sectional view of the nozzle of FIG. 11, taken along lines 13—13 in FIG. 11.
Figure 12:
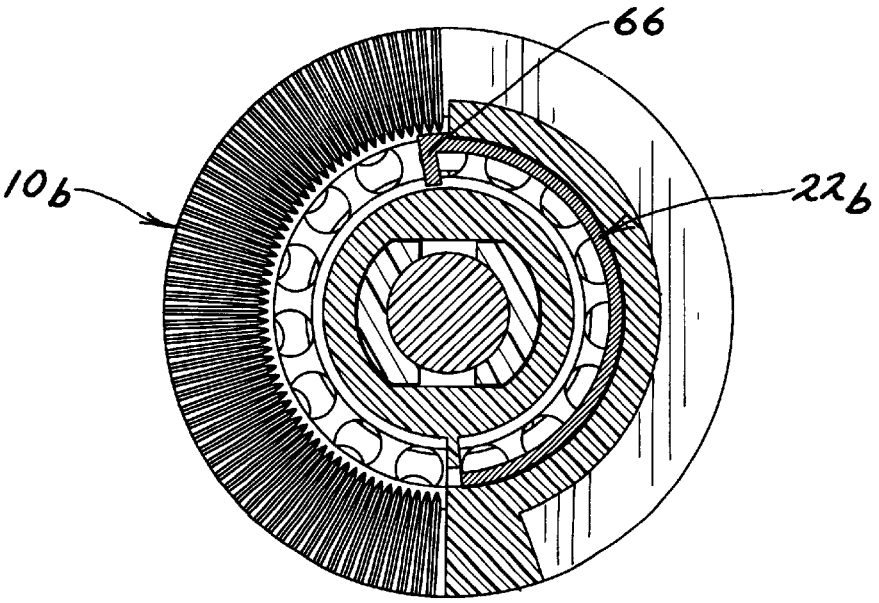
FIG. 12 is a cross-sectional view of the nozzle of FIG. 11, taken along lines 12—12 in FIG. 11.

The top and bottom slots are so dimensioned and configured that there is no gap in coverage between them. For example, the beginning of top slot $\mathbf{10}_t$ picks up where bottom slot $\mathbf{10}_b$ leaves off. Thus, if bottom slot $\mathbf{10}_b$ waters from 0° to 180°, top slot $\mathbf{10}_t$ will begin to water at 180° and continue from that point to the end of the adjustable arc. Because of the distance required for the stops 64 and 66, the actual maximum arc watered by nozzle 2 shown in this application is slightly less than 360°. See FIGS. 8 and 13 where the thickness of stops 66 and 64 on skirts $\mathbf{22}_b$ and $\mathbf{22}_t$ takes up about 10° such that each slot $\mathbf{10}_b$ and $\mathbf{10}_t$ provides only about 170° or so of maximum arc adjustment. Thus, nozzle 2 is adjustable between 0° and 340° or so.

While use of detent 60 is preferred to allow bottom slot $\mathbf{10}_b$ to fully open before top slot $\mathbf{10}_t$ beings to open, detent 60 could be dispensed with if so desired. In this case, which slot opens first will depend solely on the friction between the sections 40, 42 and 44, which will vary from nozzle to nozzle. However, it does not matter to the operation of nozzle 2. Even if top slot $\mathbf{10}_t$ were to open first before bottom slot $\mathbf{10}_b$, and then bottom slot $\mathbf{10}_b$ were to open, one still gets adjustable coverage beginning at 0° and continuing up to the maximum arc. This is also true even if bottom slot $\mathbf{10}_b$ were to open partially, and then top slot $\mathbf{10}_t$ were to open partially, and then bottom slot $10_b$ were to further open, and so on. Turning adjustment ring 26 clockwise from its fully closed, 0° position to its fully open position incrementally and infinitely increases the arc coverage regardless of which slot 10 opens first or whether one slot fully opens before the other begins opening. Using detent 60 simply gives more predictability to the user who might otherwise be confused if slots 10 on different nozzles 2 were to open in random order, which might occur without detent 60.

While the minimum arc coverage is preferably 0° relating to a fully closed position of nozzle 2, this is not strictly necessary. For example, the fully closed position of bottom flow blocking skirt $22_b$ could be one in which a small portion of bottom slot $10_b$, e.g. 30°, was left open. In this case, nozzle 2 would be one that was adjustable between 30° and the maximum arc coverage.

Nozzle 2 of this invention is one that can be universally used by installers or users of fixed spray sprinklers. The user would need to stock only nozzle 2 and nozzle 2 could be installed on all the fixed spray sprinklers in a given sprinkler system. Individual nozzles 2 would then simply be adjusted to a desired value by rotating adjustment ring 26 in the appropriate direction, i.e. clockwise to increase the arc and counter-clockwise to decrease the arc. Arrows in conjunction with + and – signs can be used on ring 26 to show which direction to turn ring 26 to increase or to decrease the arc, respectively.

The inside diameter of adjustment ring 26 has a circular array of serrations 70 that engage one or more radially outwardly extending tabs 72 provided on the fixed scale member 32. Together, the serrations 70 and 72 form yet another detent 74 that holds adjustment ring 26 in an adjusted position to prevent nozzle 2 from self-adjusting. Self-adjustment is a problem experienced by some prior art fixed spray nozzles having an adjustable arc in which the arc will sometimes change on its own without any user manipulation. In nozzle 2, the holding force provided by detent 74 is sufficient to keep adjustment ring 26 in any position to which it has been set without ring 26 moving during operation of nozzle 2. However, the user can still set a new arc by grabbing and rotating ring 26 which overcomes detent 74 with serrations 70 ratcheting over tabs 72.

Another problem experienced by prior art fixed spray nozzles having an adjustable arc is a change in arc adjustment caused by stepping on the nozzle and twisting against the top of the nozzle with one's foot. Because the nozzle is often carried at the top of a riser in a pop-up sprinkler, the top of the nozzle is at ground level when the sprinkler is not operating and the riser is retracted within the sprinkler body. It sometimes happens that a person mowing the lawn might unintentionally step on the sprinkler and exert some torque on the top of the nozzle with his foot, or a vandal might do so intentionally. In some prior art sprinklers of this type, the arc adjustment is made by twisting or rotating the entire top of the nozzle. Thus, torque applied to the top of the nozzle by a foot, either accidentally or intentionally, will change the arc setting.

Nozzle 2 of this invention is built to minimize this problem. First, only part of the top of nozzle 2, namely the adjustment ring 26, is rotated to make the adjustment and the remaining fixed portion of the top of nozzle 2, namely scale member 32, sticks up slightly above adjustment ring 26 when nozzle 2 is assembled. See FIG. 3. Thus, a user's foot will first engage against the top of scale member 32, which is not rotatable, rather than directly against adjustment ring 26. Thus, pressing down with one's foot and attempting to twist the top of nozzle 2 will usually not result in any torque being applied to adjustment ring 26.

Furthermore, even if someone's foot does engage in some fashion against adjustment ring 26 so as to attempt to turn it, ring 26 includes some downwardly facing, pointed teeth 80. See FIG. 3. These ribs 80 will engage or dig into the cap (not shown) on the upper end of the body of the pop-up sprinkler that carries nozzle 2 to further resist the foot applied torque. Ribs 80 will be most effective for this purpose if the cap of the sprinkler body is made of or covered with a softer material such as a softer rubber, thus allowing ribs 80 to more fully penetrate or dig into the cap. As a result of these features, it will be quite difficult to step on nozzle 2 and change the arc setting by twisting one's foot, which is an improvement over certain known prior art sprinklers that are adjustable from the top.

Finally, the Applicant has discovered that grooves 20 on the bottom walls of slots 10 provide good pattern definition at each side of the arc. In prior art fixed spray sprinklers having an adjustable arc, the Applicant has observed that the pattern at each side of the arc often bends inwardly as if the water passing closest to each of the walls that define the sides of the slot is being siphoned to the inside of the arc by the water flowing in interior portions of the arc. However, using grooves 20 as shown on the bottom walls of slots 10 appears to prevent this from happening. Each side of the arc being watered by the slots 10 is crisp and clean with little inward bending of the pattern.

Various modifications of this invention will be apparent to those skilled in the art. Thus, the scope of the invention shall be limited only by the appended claims.

I claim:

1. An adjustable arc fixed spray sprinkler nozzle, which comprises:

a nozzle body having a top and sides with the nozzle body having an axis;

a plurality of water discharge slots provided in the sides of the nozzle body with the slots pointing outwardly relative to the axis of the nozzle body such that water is discharged to the sides of the nozzle body through the slots, wherein each slot is horizontal and extends around only a portion of the nozzle body; and a plurality of rotatable skirts carried on the nozzle body extending parallel to the axis of the nozzle body with one skirt being in abutment with each water discharge slot, each skirt being progressively rotatable from a first position in which the skirt imposes minimum interference with the water discharge slot to a second position in which the skirt imposes maximum interference with the water discharge slot, whereby the arc coverage provided by the water flow through the water discharge slots is controlled by the position of the skirt for each slot.

2. The nozzle of claim 1, wherein the water discharge slots and their associated skirts are offset relative to one another along the axis of the nozzle body.

3. An adjustable arc fixed spray sprinkler nozzle, which comprises:

a nozzle body having at least two, sideward facing water discharge slots provided in the nozzle body; and wherein at least one water discharge slot is fixed relative to the nozzle body and at least one water discharge slot is rotatable relative to the nozzle body from a first position in which the rotatable water discharge slot at least partially overlies the fixed water discharge slot to a second position in which the rotatable water discharge slot has been rotated out of its overlying position and is oriented in a different direction from the fixed water discharge slot.

4. An adjustable arc fixed spray sprinkler nozzle, which comprises:

a nozzle body having a top and sides;

at least two water discharge slots in the sides of the nozzle body;

at least two flow blocking members movably carried on the nozzle body, wherein one flow blocking member is associated with each of the slots for adjustably blocking the slot's length to thereby control the arc coverage provided by the slot; and a single, user operable adjustment member movably carried on the nozzle body for moving both flow blocking members relative to their associated slots.

5. The nozzle of claim 4, wherein the adjustment member forms at least part of the top of the nozzle body.

6. The nozzle of claim 4, wherein the adjustment member comprises an adjustment ring that forms an exterior portion of the top of the nozzle body.

7. The nozzle of claim 6, wherein the adjustment ring rotates around an interior portion of the top of the nozzle body.

8. The nozzle of claim 7, wherein the adjustment ring and the interior portion of the top of the nozzle body have cooperating indicia means for indicating on the top of the nozzle body the arc that has been set.

9. The nozzle of claim 7, wherein the interior portion of the top of the nozzle body protrudes slightly above the adjustment ring to be engageable by a foot pressing downwardly before the adjustment ring is contacted by the foot.

10. The nozzle of claim 9, wherein the adjustment ring includes a plurality of downwardly facing teeth suited for engaging against a portion of a sprinkler body on which the nozzle is carried to further resist a foot applied torque on the adjustment ring.

11. The nozzle of claim 7, further including means for holding the adjustment ring in place during operation of the nozzle to prevent the arc from self-adjusting.

12. The nozzle of claim 11, wherein the holding means comprises a detent formed between the adjustment ring and the interior portion of the nozzle body.

13. An adjustable arc fixed spray sprinkler nozzle, which comprises:

a nozzle body having a top and sides;

at least one water discharge slot provided somewhere in the sides of the nozzle body which slot is adjustable in length to thereby control the arc coverage provided by the slot; and a rotatable adjustment ring that forms an exterior portion of the top of the nozzle body with the adjustment ring rotating around a fixed interior portion of the top of the nozzle body, wherein the adjustment ring is sized to be gripped and turned by hand, the adjustment ring when so turned adjusting the length of the water discharge slot to change the arc coverage, and wherein the adjustment ring is located above the water discharge slot.

14. The nozzle of claim 13, wherein the adjustment ring and the interior portion of the top of the nozzle body have cooperating indicia means for indicating on the top of the nozzle body the arc that has been set.

15. The nozzle of claim 13, wherein the interior portion of the top of the nozzle body protrudes slightly above the adjustment ring to be engageable by a foot pressing downwardly before the adjustment ring is contacted by the foot.

16. The nozzle of claim 13, wherein the adjustment ring includes a plurality of downwardly facing teeth suited for engaging against a portion of a sprinkler body on which the nozzle is carried to resist a foot applied torque on the adjustment ring.

17. The nozzle of claim 13, further including means for holding the adjustment ring in place during operation of the nozzle to prevent the arc from self-adjusting.

18. The nozzle of claim 17, wherein the holding means comprises a detent formed between the adjustment ring and the interior portion of the nozzle body.

* * * * *